United States Patent [19]

Wear et al.

[11] Patent Number: 4,878,533

[45] Date of Patent: Nov. 7, 1989

[54] VAPORIZATION APPARATUS AND METHOD FOR PRODUCING CURING GAS

[76] Inventors: Boyd A. Wear; Craig V. Latham; James A. Priser, all of 513 S. Lake St., Warsaw, Ind. 46580

[21] Appl. No.: 164,871

[22] Filed: Mar. 7, 1988

[51] Int. Cl.[4] ..... B22C 9/12

[52] U.S. Cl. ..... 164/16; 122/33; 164/159

[58] Field of Search ..... 164/16, 12, 159; 122/33

[56] References Cited

U.S. PATENT DOCUMENTS

| | | | |
|---|---|---|---|
| 1,891,534 | 12/1932 | Gray | 122/33 |
| 2,582,134 | 1/1952 | Kimmell et al. | 122/33 |
| 3,475,916 | 11/1969 | Smith | 122/33 X |
| 3,888,293 | 6/1975 | Laforet et al. | 164/16 |
| 4,163,371 | 8/1979 | Groninger | 122/33 X |
| 4,346,673 | 8/1982 | Gillies | 122/33 X |

*Primary Examiner*—Richard K. Seidel
*Assistant Examiner*—J. Reed Batten, Jr.
*Attorney, Agent, or Firm*—James D. Hall; Thomas J. Dodd; Todd A. Dawson

[57] ABSTRACT

A process for vaporizing a liquid curing agent includes heating the liquid curing agent while it is stored in a container. Heat is delivered to the container by a heated fluid passed through a jacket which at least partially surrounds the storage container. After vaporization, the gaseous phase curing agent, usually methyl formate, methylal, or other gases, is delivered to one or more work stations where it is used in a curing reaction.

15 Claims, 1 Drawing Sheet

VAPORIZATION APPARATUS AND METHOD FOR PRODUCING CURING GAS

BACKGROUND OF THE INVENTION

This invention relates to vaporizers and will have special but not limited application to a device and method for vaporizing fluids for use in foundry binder systems.

Most foundry binder systems are generally referred to as "cold box" systems, which means that the sand mold or core is hardened primarily by inducing a chemical reactant or catalyst upon resin treated sand. many of these cold box systems are currently available on the market and several of the most favored systems utilize methyl formate, methylal, or other liquids as a reactant or curing agent for the resin binders. Due to the speed of cure, it is necessary to first form the sand mold or core in the presence of the resins and then add the curing agent to affect hardening. Premature addition of the curing agent will often ruin the mold or core by causing the mold to harden before it is formed into the desired shape. Addition of the curing agent in its non-gaseous state to the mold or core is also undesired as this often produces imcomplete hardening of the mold.

It is for these reasons that vaporizing (or gassing) units have been developed which heat the curing agent to its boiling point and then deliver the gaseous agent selectively to the sand mold or core which has been formed. Heretofore, these machines have utilized heat vaporization techniques which are sometimes potentially dangerous and often inefficient due to the inability to properly regulate the heat throughout the container which holds the curing agent.

SUMMARY OF THE INVENTION

The vaporization apparatus and method utilized in this invention includes a jacket or envelope surrounding the curing agent container. In operation, the jacket is filled with a heated fluid (normally but not limited to water) which serves to heat the normally liquid curing agent to its boiling point. As the curing agent vaporizes, the gas is forced out of the container by vapor pressure which delivers the gas to the sand mold(s) or core(s) for curing. By utilizing indirect heating of the curing agent, fire and explosion hazards are greatly reduced, and precise, uniform temperature regulation of the container is achieved. Accurate and uniform temperature regulation of the container is desired in order to maintain the curing agent vapor at the selected system pressure which allows precise and consistent gassing of the sand mold or core.

Accordingly, it is the object of this invention to provide an improved method and apparatus for vaporizing normally liquid curing agents.

Another object of this invention is to provide for an efficient and economical method of safely vaporizing and delivering a curing agent to a sand mold or core.

Another object of this invention is to provide for a method of vaporizing a curing agent through indirect and uniform heating.

Other objects of this invention will become apparent upon reading of the following description.

BRIEF DESCRIPTION OF THE DRAWINGS

A preferred embodiment of the apparatus is depicted to illustrate the principles of the method wherein.

DETAILED DESCRIPTION OF THE INVENTION

Figure 1:
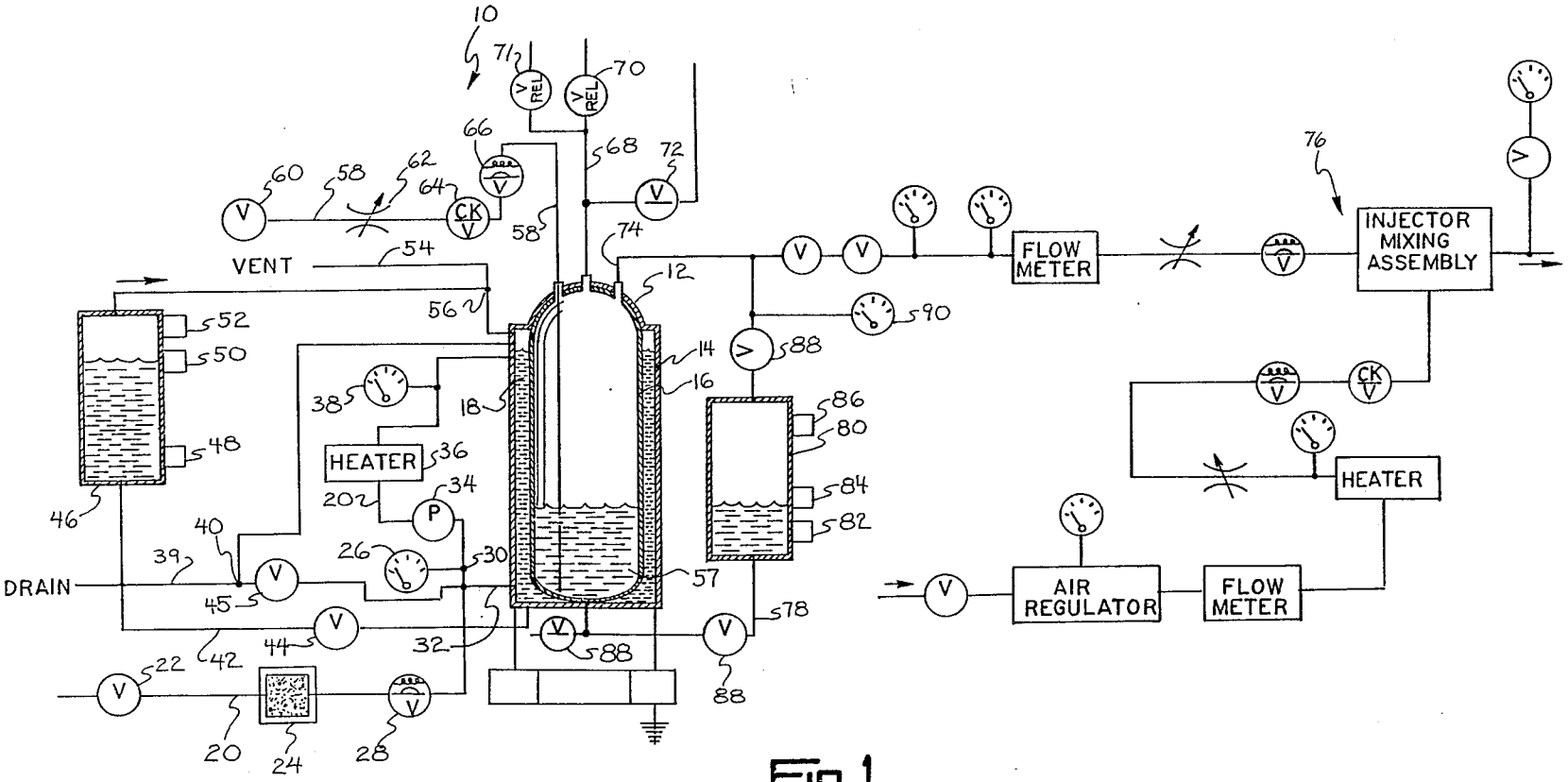
FIG. 1 is a schematic view of the apparatus of this invention.

The preferred apparatus described below is not intended to be exhaustive or to limit the scope of the invention to its precise teachings. It has been chosen and described to illustrate the method used so that others skilled in the art may be able to practice the method.

Referring now to the drawing, reference numeral 10 refers generally to the preferred vaporization apparatus used to carry out of the inventive method claimed. Apparatus 10 principally includes a pressure vessel 12 formed of durable metal such as stainless steel or the like. Pressure vessel 12 includes an insulation covered outer casing 14 and an inner casing 16 which forms a jacket or envelope type construction.

Outer casing 14 is adapted to hold heating fluid 18, preferably but not limited to water. A conduit 20 is connected to a heating fluid supply source (not shown) at one end and to outer casing 14 at the other end to provide for flow communication. Positioned along conduit 20 are a manually controlled valve 22 to control fluid flow into the conduit, a strainer 24 which filters impurities from the heating fluid, and a solenoid type valve 28, whose operation will be discussed later. A T-type connector 30 connects conduit 20 between outer casing outlet 32 and a circulatory pump 34. Pump 34 circulates the heating fluid from outer casing outlet 32 past a temperature gauge 26 to heater element 36 and through to outer casing 14. Temperature gauge 38 monitors heating fluid temperature as it exits heater element 36 to allow the operator a visual indication that the heating fluid has been heated to the correct temperature. Temperature gauge 26 monitors heating fluid temperature as it exits outer casing 14 to allow a visual indication of the temperature loss incurred by vaporizing the curing agent. A drain conduit 39 is connected to conduit 20 by T connectors 30 and 40 and also communicates with outer casing 14 to drain off excess heating fluid. A manually controlled valve 45 also communicates with outer casing 14 to allow the heating fluid to be drained from apparatus 10 if required. Metering conduit 42 may be connected to and is in flow communication with outer casing 14. A heating fluid level indicator 46 is connected to conduit 42 and includes a plurality of level switches 48, 50, and 52 which serve as indicators of the heating fluid level in outer casing 14. Vent conduit 54 is connected to heating fluid level indicator 46 by T connector 56.

The curing agent 57, usually methyl formate, methylal, or other liquids is normally obtained from a bulk supply tank (not shown) and delivered to inner casing 16 through supply conduit 58 which is in flow communication with and terminates inside and near the bottom of the inner casing. Positioned along conduit 58 are a manually operated valve 60, a flow control valve 62, and a check valve 64. An air-actuated ball valve 66 is also connected to conduit 58. A relief conduit 68 which includes automatic pressure relief valve 70, automatic vacuum relief valve 71, and manual valve 72 communicates with inner casing 16 as shown to remove excess pressure or vacuum caused by the heating or cooling of the curing agent. An outlet conduit 74, positioned as shown serves to transport vaporized curing agent from inner casing 16 to the core drop injector, referred to generally by reference numeral 76. Metering conduit 78 may be connected to and is in flow communication with inner casing 16 and outlet conduit 74 as shown. A curing agent liquid level indicator 80 is positioned along conduit 78 and includes a plurality of level switches 82, 84, and 86 which serve as indicators of the liquid level in inner casing 16. Valves 88 are positioned along conduit 78 to control and/or isolate liquid flow therethrough and pressure gauge 90 monitors line and inner casing 16 pressure.

Core drop injector 76 is a conventional device which does not form a part of this invention and hence will not be described in detail. It should be noted that multiple core drop injectors may be connected to apparatus 10 for delivering gaseous curing agent to more than one work station. It should be further noted that the workings of all automatic components of apparatus 10 are controlled by a programmable controller (not shown).

Apparatus 10 operates as follows: Valves 22 and 28 are opened to allow a quantity of heating fluid 18 to enter conduit 20 and outer casing outlet 32. Heating fluid enters outer casing 14 and fluid level indicator 46. When heating fluid is at the level indicated by level switch 48, pump 34 is switched on to circulate the heating fluid through heater element 36 to outer casing 14. Running pump 34 allows heater element 36 to be switched on and off as required to maintain heating fluid to a predetermined temperature. Valve 28 is closed automatically when heating fluid level is at or above level switch 50. Thereafter, manually controlled valve 22 is normally left opened to allow automatic addition of heating fluid to outer casing 14 by valve 28 as determined by level switch 50. Level switch 52 is used to indicate an overfill of outer casing 14 to sound an alarm.

Valves 60 and 66 are opened to deliver a quantity of liquid curing agent 57 to inner casing 16 through conduit 58 and to liquid level indicator 80 through conduit 78. Valve 66 is closed automatically when the liquid curing agent level is at or above level switch 84. Thereafter, manually controlled valve 60 is normally left opened to allow automatic addition of liquid curing agent to inner casing 16 by valve 66 as determined by level switch 84. Level switch 86 is used to indicate an overfill of inner casing 16 to sound an alarm. Level switch 82 is used to indicate low liquid curing agent level in inner casing 16.

As the heated heating fluid circulates through the outer casing 14, it heats the liquid curing agent 57 inside inner casing 16 to and above its vaporization point. As the liquid curing agent is vaporized, vapor pressure is created within inner casing 16 and outlet conduit 74 and thence to core drop injector(s) 76. System vapor pressure is regulated by controlling the heating fluid temperature inside outer casing 14. Solenoid type valves of the core drop injector(s) 76 are opened and closed accordingly to allow gaseous curing agent introduction to the sand mold or core.

It is understood that the preceding description does not limit the method or apparatus to these precise details, but may be modified within the scope of the following claims.

We claim:

1. A method of vaporizing a curing agent which exists in a normally liquid phase comprising the steps of:

(a) delivering a quantity of said liquid curing agent to a container, said container at least partially surrounded by a jacket;

(b) delivering a quantity of a preheated fluid into said jacket, with the temperature of said preheated fluid being sufficiently high to heat said container and raise the temperature of said liquid curing agent to its boiling point or higher wherein the liquid curing agent is vaporized into a gaseous phase; and (c) delivering a quantity of said gaseous phase curing agent to one or more work stations to be used in reacting or catalyzing a chemical curing reaction.

2. The method of claim 1 wherein said liquid curing agent is a curing agent for foundry sand mold and core resins or binders.

3. The method of claim 2 wherein said liquid curing agent consists of the group of materials which includes methyl formate, methylal, or other liquids.

4. The method of claim 2 wherein said work station is a foundry sand mold forming station.

5. The method of claim 2 wherein said work station is a foundry sand core forming station.

6. Apparatus for vaporizing a curing agent which exists in a normally liquid phase, said apparatus comprising container means for holding a quantity of said liquid phase curing agent, means for introducing a quantity of said liquid phase curing agent into said container means, a jacket at least partially surrounding said container means, said jacket holding a preheated fluid separate from said liquid phase curing agent with said preheated fluid being of sufficiently high temperature to heat said container means and liquid phase curing agent to a temperature at which the curing agent is vaporized into a gaseous phase, conduit means connecting said container means and a work station, and means in communication with said conduit means for delivering a quantity of said gaseous phase curing agent to said work station.

7. The apparatus of claim 6 wherein said liquid curing agent is a curing agent for foundry sand mold and core resins or binders.

8. The apparatus of claim 6 wherein said liquid curing agent consists of the group of materials which includes methyl formate, methylal, or other liquids.

9. The apparatus of claim 6 wherein said work station is a foundry sand mold forming station.

10. The apparatus of claim 6 wherein said work station is a foundry sand core forming station.

11. The apparatus of claim 6 and second conduit means connected between said jacket and a fluid supply source, pump means for circulating said preheated fluid through said second conduit means and jacket, and heater means positioned along said second conduit means for heating said fluid and maintaining the temperature of the fluid at a sufficiently high level.

12. Apparatus of claim 11 wherein said fluid is normally but not limited to water.

13. Apparatus for vaporizing a curing agent which exists in a normally liquid phase which comprises:

(a) container means at least partially surrounded by a jacket for holding a quantity of said liquid phase curing agent;

(b) a first continuous conduit connected in fluid flow communication between said jacket and a source of liquid;

(c) heater means positioned along and in flow communication with said first conduit for heating a quantity of liquid passing through the first conduit;

(d) pump means for delivering said heated liquid to said jacket whereby said liquid phase curing agent is converted into a gas phase curing agent; and conduit means for carrying a quantity of said gas phase curing agent to a work station.

14. Apparatus of claim 13 and level indicator means positioned along said first conduit for visually indicating the level of liquid present in said jacket, said level indicator means including switch means for sounding an alarm in the event said jacket is overfilled with said liquid.

15. Apparatus of claim 13 and level indicator means positioned along said conduit means for visually indicating the level of curing agent present in said container means, said level indicator means including switch means for sounding an alarm in the event said container means is overfilled with said liquid phase curing agent.

* * * * *